United States Patent [19]

Weeks

[11] Patent Number: 4,649,790

[45] Date of Patent: Mar. 17, 1987

[54] FOOT-JOINT FOR A TRANSVERSE FLUTE

[76] Inventor: Alexander J. Weeks, 15 Grandison Road, London, United Kingdom, SW11 6LS

[21] Appl. No.: 793,106

[22] Filed: Oct. 30, 1985

[30] Foreign Application Priority Data

Oct. 30, 1984 [GB] United Kingdom ..... 8427417

[51] Int. Cl.[4] ..... G10D 7/02

[52] U.S. Cl. ..... 84/384

[58] Field of Search ..... 84/384, 380 R

[56] References Cited

U.S. PATENT DOCUMENTS 920,471 5/1909 Jenner ..... 84/384

*Primary Examiner*—Lawrence R. Franklin

*Attorney, Agent, or Firm*—Bacon & Thomas

[57] ABSTRACT

An axial passage of a flute foot-joint has an end portion whose circular transverse section increases in diameter in a direction towards the open end of the foot-joint to a maximum substantially at said open end.

7 Claims, 3 Drawing Figures

FOOT-JOINT FOR A TRANSVERSE FLUTE

This invention relates to improvements in foot-joints for transverse or side-blown flutes.

Transverse flutes conventionally comprise three parts, namely the head-joint, the centre-joint and the foot-joint, and the connections between these parts are tenon and socket joints. The basic design provides a cylindrical passage in the foot and centre-joints, and a head-joint having a passage which tapers in a direction away from the centre-joint.

Previous proposals have been made regarding the design of transverse flutes, such as the nature of the taper in the head-joint, the position of the tone holes in the cylindrical passage formed in the foot- and centre-joints, the size of these tone holes, and more recently the size of the passage itself, all with a view to improving the quality of the instrument.

I have now discovered that if contrary to the hitherto universal construction of the instrument the open end of the foot-joint is outwardly flared or made bell-shaped a surprising improvement in the quality and volume of sound produced can be obtained.

Thus according to the present invention there is provided a foot-joint for a transverse flute, the axial passage of which has an end portion whose transverse section increases in a direction towards the open end of the foot-joint to a maximum substantially at said open end.

Such a foot-joint has several advantages over conventional flute foot-joints. The volume of sound produced by a transverse flute equipped with a foot-joint in accordance with the invention is greater, and this is of course a characteristic sought by players. Increased volume is particularly desirable when the instrument is to be played as a solo instrument accompanied by an orchestra or an ensemble of other instruments when the conventional flute can easily be rendered inaudible particularly in the lower register where the flute is weakest. In a transverse flute according to the present invention the volume of sound produced on playing the lower notes is greatly increased.

The end portion of the axial passage having an increasing size may take various shapes. For example the rate of increase towards the open end of the foot-joint may be constant so that the end portion is conical in shape, but preferably the rate of increase becomes progressively greater towards said open end to define a "bell" shaped passage portion. In one preferred embodiment the side wall of the end portion of the passage viewed in a longitudinal section follows a parabolic arc.

Preferably the passage end portion is substantially circular in transverse section and the passage diameter increases from its minimum to its maximum by a factor of between 1.2 and 1.6, but it has been found in practice that the best results are obtained when this factor is about 1.5.

Preferably the tone hole for the lowest note of the flute, i.e. that nearest the open end of the foot-joint, is formed in said end portion of the axial passage having an increasing size. However, in order to simplify the construction of the key-post for this tone hole, the end portion may be shortened such that the key-post is aligned with a cylindrical part of the axial passage. Thus the length of the end portion having an increasing size can be varied to some extent, and indeed the end portion length is preferably greater than the minimum passage diameter by a factor varying between 1.0 and 4.2.

In the preferred arrangement where the lowest tone hole is formed in the end portion itself, this factor is about 3.2.

In the simplified construction for the keypost referred to above, the end portion of the axial passage could even be formed in a separate component of the foot-joint, the separate component being attachable by suitable means such as, for example, a tenon and socket joint.

Preferably, the foot-joint is longer than a conventional foot-joint to compensate for the sharpening effect the end portion of the invention has on the lower notes.

The invention also provides a transverse flute including a separable foot-joint of the type hereinbefore described, including the various modifications discussed.

Two embodiments of the invention will now be described, by way of example only, with reference to the accompanying drawings in which.

Figure 1:
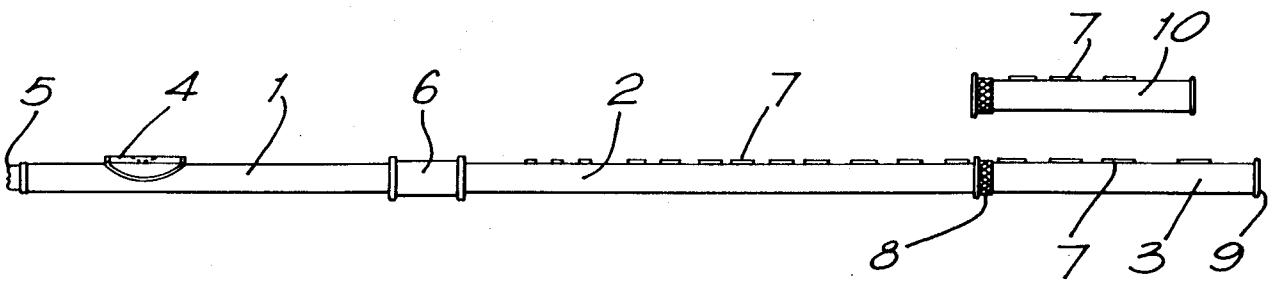
FIG. 1 shows a general view of a transverse flute equipped with a conventional "B" foot-joint, and a conventional "C" foot-joint which may be optionally used.

Referring to FIG. 1, this shows the three parts of a conventional transverse flute, namely the head-joint 1, the centre-joint 2 and the foot-joint 3. The head-joint includes a side-blown mouthpiece 4 in one side wall thereof and has an axial passage of circular transverse section which tapers in a smooth curve towards a closed end 5. Typical dimensions of such a passage are 17 mm at the closed end, 17.8 mm at the mouthpiece and 19 mm at the end connected to the centre-joint. Thus the taper is only slight in relation to the diameter of the passage. The head-joint 1 is connected to the centre-joint 2 by means of a conventional tenon and socket joint 6, and the centre-joint is provided with a cylindrical axial passage of constant transverse section, typically 19 mm in diameter. Leading off from the centre-joint passage are spaced tone holes provided with key-posts 7 and keys (not shown). The centre-joint 2 is connected to the foot-joint 3 by means of a tenon and socket joint 8, and the foot-joint also has a cylindrical axial passage of 19 mm in diameter, the passage extending to an opening 9 at the end of the flute.

In FIG. 1, the foot-joint 3 is a "B" footjoint, and is provided with four tone holes having key-posts 7 so that the lowest obtainable note is "B". Another foot-joint 10 is shown, this being a "C" foot-joint since it has only three tone holes and its lowest note is "C". The axial passage of the "C[ foot-joint is also cylindrical.

Figure 2:
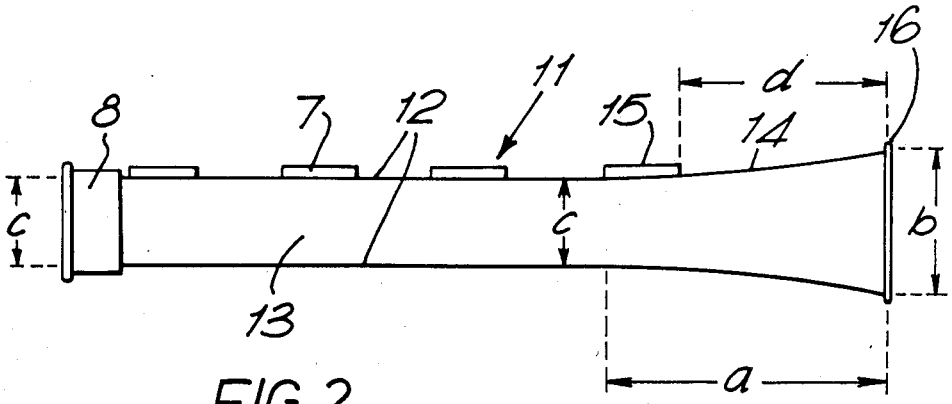
FIG. 2 shows a "B" foot-joint in accordance with the invention.

FIG. 2 shows a preferred embodiment of the invention in the form of a "B" foot-joint 11. As in conventional foot-joints, this is connectable to the centre-joint by means of a tenon and socket joint 8, is provided with four tone holes having key-posts 7 and has a passage 13 of circular transverse section having an opening 9 at the end. The diagrammatic lines 12 of FIG. 2 represent the inner wall of the axial passage 13 of the foot-joint 11, and it will be seen that in an end portion 14 of the foot-joint passage 13 the size of the passage increases in a direction towards the end 9 of the foot-joint. The gradient of the inner wall of end portion 14 increases towards the end 9 of the foot-joint, so that end portion 14 is "bell" shaped. Although differing lengths of end portion 14 are possible, it has been found that a length "a"

of 60.0 mm is particularly suitable with the diameter "b[ at the passage end being 28.0 mm. The diameter "c" of the remaining portion of passage 13 is constant and equal to the diameter of the centre-joint, i.e., 19.0 mm. Thus in this embodiment the passage diameter of the end portion 14 increases from its minimum to its maximum by a factor of 28/19 or about 1.5.

In a "B" foot-joint the distance "d" of the side of the key-post 15 of the lowest tone-hole from the end 9 is normally less than 60.0 mm, so that in the preferred arrangement this key-post must be actually built on the "bell" shaped end portion of the foot-joint, as shown. This requires considerable expertise, and in a simplified arrangement it is possible to have an end portion having a reduced length, such that the key-post 15 of the lowest tone-hole can be built to align with the cylindrical part of the passage 13 to simplify the construction. In such a case the length of the end portion "a" may, for example, be 40.0 mm. Thus although the length of the end portion 14 is preferably greater than the minimum passage diameter by a factor of 60/19, or about 3.2, in the simplified arrangement this factor is only 40/19, or about 2.1.

The overall length of the foot-joint 11 is greater than the standard "B" foot-joint in order to compensate for the sharpening effect which the larger opening at the foot-joint end has on the lower notes. With the preferred dimensions discussed above, it has been found that the corresponding increase in length required is 10.0 mm. The positioning of the tone-holes 7 relative to the tenon and socket joint 8, and hence relative to the mouthpiece, in the foot-joint 11 is the same as that of conventional foot-joints so that the additional length is provided to the right of key-post 15 as viewed in FIG. 2.

Transverse flutes are generally made of pure silver or nickel silver with silver plate. In the process of forming the "bell" shaped end portion 14 of the foot-joint passage, from an originally cylindrical blank, the side wall of the passage 13 nearest the end 9 becomes markedly thinner than the side wall in the cylindrical portion of the foot-joint. In order to reinforce the end 9, a ring 16 is provided, and this has the further benefit of a pleasing appearance.

Figure 3:
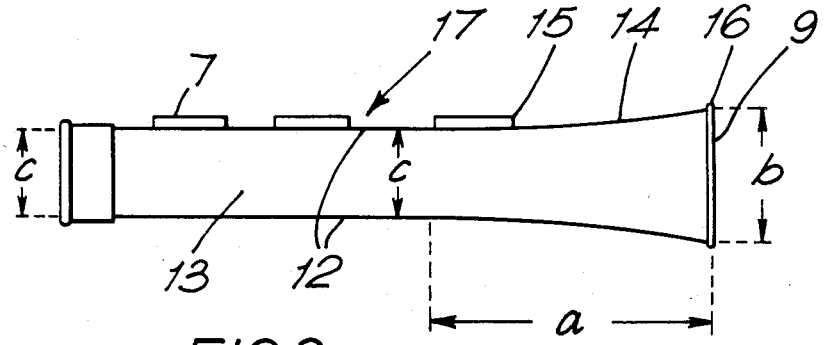
FIG. 3 shows a "C" foot-joint in accordance with the invention.

FIG. 3 illustrates another embodiment of the invention in the form of a "C" foot-joint 17. This is labelled similarly to foot-joint 11 of FIG. 2, and differs therefrom by having one less tonehole and being correspondingly shorter in length. The preferred dimensions "a" and "b" are similarly 60.0 mm and 28.0 mm respectively, while the overall length of foot-joint 17 is also greater than standard without altering the position of the tone-holes 7 relative to the tenon and socket joint 8.

Both embodiments of the invention not only produce a greater volume of sound than that produced by conventional transverse flutes, but there is a further benefit that the overall quality of sound produced is much improved. The flute not only sounds better but is more flexible enabling the player to create greater differences in sound colour and dynamics. A further advantage is that in the very high notes on the flute, which are generally difficult to play, there is both greater ease of production and improved sound quality.

Modifications to the specific embodiments and to any broad aspects thereof referred to or suggested herein may be apparent to those skilled in the art and the disclosure hereof is intended to encompass any such modifications.

I claim:

1. A foot-joint for a transverse flute having a body portion, the foot-joint comprising first and second axially opposite ends, means provided at said first end for connecting the foot-joint to said body portion of the flute in such a manner that the foot-joint can be separated from said body portion, and an axial passage extending between and communicating said first and second ends, the passage being open at said second end and having a terminal portion with a substantially circular transverse section, the diameter of which increases in size in a direction towards the open end of the passage to a maximum substantially at said open end, the diameter of the terminal portion increasing from its minimum to its maximum by a factor of between 1.2 and 1.6.

2. A foot-joint as claimed in claim 1, wherein said factor is about 1.5.

3. A foot-joint as claimed in claim 1 wherein the rate of increase of said transverse section becomes progressively greater towards said open end to define a bell shaped passage terminal portion.

4. A foot-joint as claimed in claim 1, wherein the length of the terminal end portion having an increasing size is greater than the minimum passage diameter by a factor of between 1.0 and 4.2.

5. A foot-joint as claimed in claim 4, wherein said factor is about 3.2.

6. A foot-joint as claimed in claim 1 further including a plurality of spaced tone holes between the opposite ends, and wherein the tone-hole nearest the open end of the axial passage is formed in said terminal portion of the axial passage having an increasing size.

7. A transverse flute including a head-joint, a centre-joint and a foot-joint which are connected together to form a continuous axial passage, wherein the foot-joint comprises first and second axially opposite ends and means for connecting said first end to said centre-joint in such a manner that the foot-joint can be separated from the centre-joint, the axial passage extending through said foot-joint to communicate the first end thereof with the second end thereof, the axial passage being open at said second end and having a terminal portion with a substantially circular transverse section the diameter of which increases in size in direction towards the open end of the passage to a maximum substantially at said open end, the diameter of the terminal portion increasing from its minimum to its maximum by a factor of between 1.2 and 1.6.

* * * * *